United States Patent [19]

Clarke et al.

[11] 4,341,862

[45] Jul. 27, 1982

[54] VESICULAR RECORDING MATERIALS

[75] Inventors: Stuart G. Clarke, Colchester; William A. Craig, Capel St. Mary, both of England

[73] Assignee: Bexford Limited, London, England

[21] Appl. No.: 226,022

[22] Filed: Jan. 19, 1981

[30] Foreign Application Priority Data

Jan. 24, 1980 [GB] United Kingdom ..... 8002474

[51] Int. Cl.[3] ..... G03C 1/76

[52] U.S. Cl. ..... 430/327; 430/152; 430/168; 430/169; 430/290; 430/935

[58] Field of Search ..... 430/169, 327, 152, 290, 430/168, 935

[56] References Cited

U.S. PATENT DOCUMENTS 3,149,971 9/1964 Baril et al. ..... 430/152
3,684,547 8/1972 Bunas et al. ..... 430/169
3,841,874 10/1974 Nishino ..... 430/152

FOREIGN PATENT DOCUMENTS 531120 2/1977 U.S.S.R. ..... 430/152

*Primary Examiner*—Charles L. Bowers, Jr.
*Attorney, Agent, or Firm*—Cushman, Darby & Cushman

[57] ABSTRACT

Process for the production of vesicular recording materials. The photographic characteristics such as speed and contrast of vesicular recording materials are improved by treating the light-sensitive vesicular recording layer with an aqueous medium at 5° to 30° C. for at least 45 minutes. The treatment may be effected by spraying with cold water and winding the wet material into a roll. Water marking in the wound roll can be avoided by coating the recording layer prior to water treatment with an antimarking composition such as a solution of nitrocellulose.

8 Claims, No Drawings

VESICULAR RECORDING MATERIALS

The present invention relates to a process for the production of vesicular recording materials.

Vesicular recording materials are known in the art and generally comprise a transparent or opaque film or sheet support carrying an imaging layer comprising a thermoplastics vehicle and a sensitising agent dispersed through the vehicle. The sensitising agent is decomposable on exposure to a light image to evolve a gas such as nitrogen thereby forming a latent gas image in the vehicle. Generally, the latent image may be developed by softening the vehicle by heating to enable the gas in the light-struck areas to expand into bubbles or vesicles which have a light-scattering or reflecting activity. A typical assembly is described in GB Pat. No. 861,250.

Various proposals for enhancing the photographic characteristics of vesicular recording materials have been disclosed in the art. U.S. Pat. No. 3,149,971 describes a process for increasing the photographic speed and reducing contrast or gamma by treating the vesicular imaging layer with an aqueous fluid maintained at an elevated temperature. The aqueous treating fluid may be steam or water vapour or alternatively a liquid at a temperature of 140° to 212° F. (60° to 100° C.).

U.S. Pat. No. 3,684,547 describes an alternative process for modifying the photographic activity of a vesicular recording film wherein a vesicular imaging layer comprising polyvinyl formal as the thermoplastics vehicle is subjected to a water treatment at 20° to 35° C. for 30 to 500 seconds and air curing or drying at 0° to 45° C. for at least 30 seconds but not longer than 10 minutes before winding the film into a roll.

U.S. Pat. No. 3,841,874 describes another process for modifying the photographic activity of vesicular recording films, especially their speed and gamma, wherein the vesicular imaging layer is treated with an alkanol and is allowed to equilibrate to permit absorbed alkanol to be released. The alkanol treatment may be followed by treatment with water at 20° to 90° C. for 1 to 100 seconds. Control experiments wherein the imaging layer is treated with water but not with an alkanol resulted in poor photographic properties. A typical control experiment is described in Example XI wherein the water treatment is effected at 23° C. for 7 minutes, the film is dried with tissue paper and equilibration occurs in ambient atmosphere for about 72 hours.

The present invention relates to a process for treating a vesicular recording material with an aqueous medium whereby certain improvements in the photographic characteristics of the material, such as speed and contrast, are obtained.

According to the present invention, a process for the production of a vesicular recording material comprises producing a plastics vehicle comprising a thermoplastics component having dispersed uniformly therein a sensitising agent which releases a vesicle-forming gas upon exposure to light, said thermoplastics component being water-insoluble and softenable upon heating to permit the gas released by the sensitising agent in the light-struck areas to form light-scattering or reflecting vesicles therein, wherein the plastics vehicle is subjected to treatment by an aqueous medium, said treatment being effected by maintaining the plastics vehicle continuously in contact with the aqueous medium for a duration of at least 45 minutes, said aqueous medium being maintained throughout said treatment at a temperature in the range 5° to 30° C.

The invention also relates to the vesicular recording material produced by such a process.

The process of the invention, involving essentially a sensitising step during the manufacture of the film and prior to imaging exposure, is a simple process which does not involve the inconveniences of the prior art processes such as treatments utilising heated vapours or liquids or hazardous organic solvents.

Certain terms employed throughout this specification have the following meaning:

"Maximum projection density" ($D_{max}$) relates to the densest image which can be produced in a processed material, the values quoted hereinafter being measured by a Macbeth densitometer TD 528 at an aperture of f4.5 using a Wratten 106 filter.

"Bar-gamma" is a measure of the imaging contrast of the recording material and is determined from the characteristic curve of the material relating to projection density plotted against the logarithm (base 10) of the exposure time. The characteristic curve relating to some conventional photographic films, such as films comprising light-sensitive silver halide emulsions, includes a straight-line portion from which it is normal practice to determine the contrast, which is termed "gamma", as the slope of the straight-line portion. However, in the case of vesicular recording materials, the characteristic curve does not have a straight-line portion. The imaging of such films normally utilises the regions of the curve between its low density "toe" and high density "shoulder" portions and their contrast, which is termed "bar-gamma" is determined as an average slope of the portion of the curve between the "toe" and "shoulder" portions. "Bar gamma" and techniques for its determination are known in the art. A method of measurement is described in ANSI PH 2.2 and in NMA Journal, Volume 1, No. 2, Winter 1968, pages 49 to 52, "A Review of Federal Specification L-F-315b" by John P. Deley and John S. Dyer. "Bar-gamma" values mentioned in this specification were determined from the characteristic curve wherein the projection density was determined for each step on the recording material after exposure through a Kodak No. 2 step tablet and development assessed using a Macbeth densitometer TD 528 at an aperture of f4.5 using a Wratten 106 filter. The plotted exposure value relates to the UV diffuse densities of the Kodak No. 2 step tablet. For low bar-gamma, a small change in exposure produces a small change in density whilst for high bar-gamma, the same small change in exposure produces a larger change in density.

"Nitrogen permeability constant" refers to the volume of nitrogen in $cm^3$ which diffuses in one second through one cm of a sample of the polymeric vehicle, one $cm^2$ in area, and under a pressure gradient of one cm of mercury at a constant temperature of 25° C.

"$D_{min}$" relates to the lowest density which can be obtained in a processed material, the values quoted hereinafter being measured by a Macbeth densitometer TD 528 at an aperture of f4.5 using a Wratten 106 filter.

"Comparative speed rating" defines the comparative speeds of recording materials at defined projection densities and is derived from the characteristic curve (projection density/$\log_{10}$ exposure derived in the determination of "bar-gamma"). The speed rating at ($1.8+D_{min}$) is determined from this curve as the $\log_{10}$ exposure value corresponding to a projection density of 1.80 plus the minimum projection density ($D_{min}$). The comparative speed rating of various recording materials at $(1.8+D_{min})$ is derived by expressing the speed rating of each recording material as a percentage of the speed, taken as 100%, of a standard film supplied by the Association of Reproduction Materials Manufacturers.

The vesicular recording material preferably comprises a layer of the plastics vehicle applied as a recording layer to a carrier sheet or film. Opaque carriers may be used in vesicular recording materials when the image is to be viewed by reflection. In such an assembly, the imaging vesicles or bubbles appear white by reflection of incident light. The opaque carrier is preferably dark in colour to contrast with the image and may comprise a pigmented or coloured plastics film or sheet, or paper or card. When the image is to be viewed by light-scattering, the carrier is preferably a transparent plastics sheet or film. In either case the plastics film or sheet may consist of any suitable plastics material such as cellulose esters, e.g. cellulose acetate, polystyrene, polyamides, polymers and copolymers of vinyl chloride, polycarbonate, polymers and copolymers of olefines, e.g. polypropylene, polysulphones and linear polyesters which may be obtained by condensing one or more dicarboxylic acids or their lower alkyl diesters, e.g. terephthalic acid, isophthalic, phthalic, 2,5-, 2,6- and 2,7- naphthalene dicarboxylic acid, succinic acid, sebacic acid, adipic acid, azelaic acid, diphenyl dicarboxylic acid and hexahydroterephthalic acid or bis-p-carboxyl phenoxy ethane, optionally with a monocarboxylic acid, such as pivalic acid, with one or more glycols, e.g. ethylene glycol, 1,3-propanediol, 1,4-butanediol, neopentyl glycol and 1,4-cyclohexanedimethanol. Biaxially oriented and heat-set films of polyethylene terephthalate are particularly useful as carriers according to this invention.

The thermoplastics component of the plastics vehicle may comprise any thermoplastics polymer which is softenable at conventional developing temperatures in the range 90° to 150° C. to permit the latent gas image to expand into imaging vesicules or bubbles. The vehicle may comprise any of the thermoplastics polymers known in the art for use in vesicular imaging layers and having properties such that light-scattering or reflecting vesicles or bubbles can be formed therein. Suitable thermoplastics include polymers of vinylidene chloride as described in GB Pat. No. 861,250, the polymers described in GB Pat. Nos. 1,272,894, 1,276,608, 1,278,004, 1,312,573, 1,330,344, 1,352,559, 1,352,560 and 1,400,245, and copolymers derived from comonomers comprising acrylonitrile and a substituted or unsubstituted styrene, and terpolymers of vinylidene chloride, acrylonitrile and methyl methacrylate.

A preferred thermoplastics component comprises a terpolymer of vinylidene chloride/acrylonitrile or a derivative thereof/methyl methacrylate, especially a terpolymer comprising the respective amounts of 30 to 45/40 to 60/5 to 20 mole %. These terpolymers provide excellent image thermal stability and the recording materials comprising them are resistant to fogging when subjected to relatively high temperatures, e.g. by the lamp employed for exposing the material during the imaging operation, such temperatures being lower than the temperatures normally employed for softening the vehicle to permit the latent gas image to expand into image recording vesicles. Increasing amounts of acrylonitrile or derivative thereof within the range 40 to 60 mole % result in higher glass-transition temperatures and hence provide thermal stability at correspondingly higher temperatures. Likewise, increasing amounts of methyl methacrylate in the range 5 to 20 mole % improve thermal stability at higher temperatures. A useful combination of imaging properties and thermal stability is provided by terpolymers of 40 to 45 mole % vinylidene chloride, 40 to 50 mole % acrylonitrile or derivative thereof and 8 to 17 mole % methyl methacrylate. Especially preferred terpolymers comprise a terpolymer of 42.5 mole % vinylidene chloride, 42.5 mole % acrylonitrile and 15 mole % methyl methacrylate and a terpolymer of 42.5 mole % vinylidene chloride, 47.5 mole % acrylonitrile and 10 mole % methyl methacrylate.

Another preferred group of thermoplastics materials comprises copolymers consisting of vinylidene chloride/acrylonitrile, especially copolymers consisting of the 40 to 85 mole % vinylidene chloride.

The sensitising agent incorporated into the plastics vehicle may comprise any of the sensitising agents known in the vesicular recording art and should be non-reactive with the vehicle and uneffected by the aqueous treatment medium. Likewise the vesicle-forming gas which is liberated by the sensitising agent should be non-reactive with the vehicle. The preferred sensitising agents are those which liberate nitrogen on exposure to actinic light, especially ultra-violet light which is widely used in vesicular processing equipment, suitable agents including nitrogen liberating diazonium salts, such as those which may be derived from the following amines:

N,N-dimethyl-p-phenylenediamine
N,N-diethyl-p-phenylenediamine
N,N-dipropyl-p-phenylenediamine
N-ethyl-N-$\beta$-hydroxyethyl-p-phenylenediamine
N,N-dibenzyl-3-ethoxy-4p-phenylenediamine
4-N-morpholino-aniline
2,5-diethoxy-4- N-morpholino-aniline
2,5-dimethoxy-4-N-morpholino-aniline
2,5-di-(n-butoxy)-4-N-morpholino-aniline
4-N-pyrrolidino-aniline
3-methyl-4-N-pyrrolidino-aniline
3-methoxy-4-N-pyrrolidino-aniline
2-ethoxy-4-N,N-diethylamino-aniline
2,5-diethoxy-4-benzoylamino-aniline
2,5-diethoxy-4-thio-(4'-tolyl)-aniline Other suitable sensitising agents include quinonediazides and especially that having the structure:

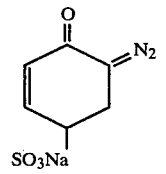

and azide compounds derived from the structure:

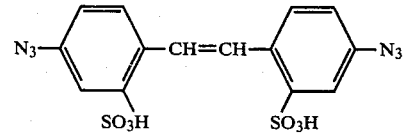

Alternatively, carbazido compounds (carboxylic acid azides) containing a hydroxyl or amino group in the position ortho to the carbazido group may be used.

Optimum image formation and vesiculation is obtained in plastics vehicles which include nitrogen-liberating sensitising agents when the thermoplastics component has a nitrogen permeability constant in the range $1\times10^{-15}$ to $1\times10^{-10}$.

Alternatively, other known sensitising agents which liberate gases other than nitrogen may be employed, e.g. those agents described in GB Pat. No. 1,359,086 and U.S. Pat. No. 3,549,376.

If desired, a small quantity of a surfactant, dyestuff or stabilising acid may be included in the plastics vehicle.

In embodiments of the invention wherein the plastics vehicle is applied as a recording layer to a carrier sheet or film, the layer may be applied by any coating operation known in the art.

When the recording layer is applied as a solution, any suitable common organic solvent may be employed, such as acetone butan-2-one, toluene, methanol, methyl ethyl ketone or methyl Cellosolve or mixtures thereof.

If desired, the surface of the carrier may be pretreated and/or coated with an adhesion-promoting layer prior to the application of the recording layer. The adhesion of the recording layer to a plastics sheet or film carrier may in particular be improved by such a treatment. Polyethylene terephthalate film carriers may be pretreated by coating with solutions of materials having a solvent or swelling action on the film such as halogenated phenols in common organic solvents, e.g. solutions of p-chloro-m-cresol, 2,4-dichlorophenol, 2,4,6- or 2,4,5-trichlorophenol or 4-chlororesorcinol or a mixture of such materials in acetone or methanol. After application of such a solution the film surface can be dried and heated at an elevated temperature for a few minutes, e.g. 2 minutes at 60° C. to 100° C. If desired, the pretreating solution may also contain an adhesion-promoting polymer such as a partially hydrolysed copolymer of vinyl chloride and vinyl acetate.

As an alternative to, or in addition to, such a pretreatment, a material having a swelling or solvent action upon the film may be incorporated into the coating composition from which the recording layer is applied.

The aqueous medium used for the treatment of the plastics vehicle preferably comprises distilled or deionised water. The improvements in the photographic characteristics obtainable according to the process of the invention can be achieved without including any additives in the aqueous medium but can nevertheless be achieved by treatment with aqueous dispersions, solutions, or mixtures with an alkanol such as methanol or ethanol. The aqueous medium may optionally contain a surfactant.

The aqueous treatment is carried out at a temperature in the range 5° to 30° C. and preferably at ambient temperature, e.g. in the range of 10° to 26° C.

The aqueous treatment is effected by maintaining the light-sensitive vesicular plastics vehicle in contact with the aqueous medium for a duration of at least 45 minutes. Treatments of shorter duration, although having a modifying effect upon the photographic characteristics of the material, are insufficient to provide acceptable imaging properties. Acceptable imaging properties, typically a maximum projection density of about 2.25, a comparative speed rating of about 70 and a bar-gamma of about 3.25 with the preferred vinylidene chloride terpolymer and copolymer thermoplastics components described above, are achieved after an aqueous treatment for 45 minutes. Such properties are broadly similar to those which can be obtained by using the hot water or water vapour treatment described in U.S. Pat. No. 3,149,971.

Further substantial improvements in the photographic characteristics in comparison with those achievable after treatment for 45 minutes are obtained with treatment times in the range 45 to 70 minutes. For example, with the preferred vinylidene chloride terpolymers and copolymers, optimum photographic properties are provided after about 70 minutes beyond which there is little significant modification in the properties. Very effective properties are obtained after a treatment time of about 60 minutes. Accordingly, it is preferred that treatment with the aqueous medium should be effected for at least 60 minutes and most preferably for at least 70 minutes. There is, however, no maximum duration of treatment beyond which the material or its properties are adversely affected.

The treatment with the aqueous medium may be effected by immersion in a bath of the medium or by spraying or coating with the medium in order to deposit a continuous layer of the medium over and in contact with the sensitised vesicular vehicle. The wetting layer of the aqueous medium is maintained in contact with the sensitised vesicular vehicle throughout the treatment.

It will be appreciated that the duration of the aqueous treatment according to the invention may be unduly prolonged to form the basis of a convenient continuous commercial process. However, it has been surprisingly discovered that the improvements in photographic characteristics are obtained by applying a layer of the aqueous medium to the plastics vehicle of the recording material and then winding the wet recording material into a roll. The aqueous medium may be applied by coating or spraying. Treatment is effected by storing the wound wetted roll under the conditions of temperature and time described above. According to this embodiment, the vesicular recording material is wound into the roll without removing or drying the aqueous medium. Although the aqueous medium tends to be absorbed into the plastics vehicle, the surface of the vehicle remains wet when the recording material is wound into the roll. The aqueous medium is preferably applied in a sufficient quantity to form a substantially uniform and continuous film over the plastics vehicle under the winding tension generated when the recording material is wound into a roll. The layer of aqueous wetting medium is maintained in the wound roll throughout the whole duration of the treatment, that is for at least 45 minutes, preferably 60 minutes and most preferably 70 minutes. In order to avoid the need for drying when the roll is unwound, the quantity of aqueous medium applied preferably does not exceed the amount of the medium which is absorbed by the plastics vehicle and the carrier sheet or film. It has been found that, for plastics vehicles of conventional thickness in the range 5 to 10 $\mu$m and a typical carrier comprising a conventional biaxially oriented and heat-set polyethylene terephthalate film, a surface concentration of aqueous medium 50 to 300 $\mu g/cm^2$ provides a satisfactory improvement in photographic characteristics without undue retention of moisture between the wound layers of the recording material. Particularly preferred surface concentrations for the applied aqueous medium are in the range 100 to 200 $\mu g/cm^2$. The wound rolls of recording material may then be maintained at the temperatures and for the duration of treatment which are effective in the process according to this invention described above.

In the commercial manufacture of vesicular films it is conventional practice to store the rolls of film after coating with the plastics vehicle, often for several days, before slitting into narrower width rolls suitable for customer use. The process of the invention can therefore be carried out simply by storing the rolls of film wound from wet vesicular recording materials as described above. Storage at ambient temperature within the prescribed range 5° to 30° C. suffices to achieve the results of the invention without imposing any special temperature conditions.

Applicants have discovered that the simple treatment of the plastics vehicle with an aqueous medium and winding the recording material whilst still wet into a roll may result in the water marking of the surface of the plastics vehicle when the recording material is unwound. Such water marking has no substantial adverse effect upon the technical performance of the recording material and in particular does not affect its photographic sensitometry; it does nevertheless influence the appearance of the recording material.

Water marking can be avoided, if desired, by coating or treating the plastics vehicle with a material which suppresses the marking effect. A preferred coating comprises a coating of nitrocellulose which may be applied as a solution in an organic solvent such as an alkanol, preferably methanol, over the plastics vehicle prior to treating the vehicle with the aqueous medium and winding the material into a roll. The applied coating may optionally include conventional additives such as filler particles, e.g. silica particles, for improving the handling properties, such as slip and anti-blocking properties, of the material.

Alternatively, the inclusion of an alkanol such as methanol or ethanol in the aqueous medium is effective in suppressing the water-marking effect.

The recording materials of the invention may be exposed to a light image in a conventional manner to produce a latent image in the plastics vehicle or recording layer. The image may be developed in a conventional manner by heating immediately after light exposure to permit the gas vesicles to form in the light-struck areas. Fixing may then be accomplished by a further overall light exposure and permitting the gas evolved by the decomposition of the sensitising agent to diffuse out of the recording layer. Alternatively, the latent image may be reversal processed by permitting the gas evolved in the imagewise light-struck areas to diffuse out of the recording layer and then subjecting the material to an overall light exposure followed by immediate heating to form gas vesicles in the area subjected to the overall exposure. The recording materials produced according to the invention record satisfactory vesicular images and have particularly good speed and contrast properties.

The invention is further illustrated by the following examples.

EXAMPLE 1

A homogeneous vinylidene chloride/acrylonitrile copolymer of respective molar proportions 43%/57% was prepared by emulsion polymerisation in the presence of a surfactant which is commercially available as 'Manoxol' OT (sodium dioctyl sulphosuccinate). The copolymer was isolated by coagulation in an aqueous magnesium sulphate solution and washed with water and vacuum dried. A coating solution comprising the resulting copolymer was made up to the composition:

| | |
|---|---|
| Vinylidene chloride/acrylonitrile copolymer (43/57 mole %) | 23.25 kg |
| Maleic acid | 0.23 kg |
| 'Manoxol' OT (a commercially available surfactant - sodium dioctyl sulphosuccinate) | 0.465 kg |
| 2,5-diethoxy-4-N-morpholino-benzene diazonium fluoroborate | 1.86 kg |
| Bis-(4-hydroxyphenyl) sulphone | 1.16 kg |
| Blue dyestuff (commercially available as 'Orasol' Blue BLN) | 0.14 kg |
| Acetone | 138 liters |
| Methyl Cellosolve | 17 liters |

One side of a 125 μm thick transparent biaxially oriented and heat-set film of polyethylene terephthalate was pretreated with a solution of 2 g of p-chloro-m-cresol in 100 ml of methanol and dried at 120° C. for 150 seconds. The vinylidene chloride copolymer coating composition was then applied by a slot coating technique as a recording layer to the pretreated surface of the film and dried at 120° C. for 150 seconds to a dry coat thickness of 7 μm.

An anti-water marking composition was prepared from the following ingredients:

| | |
|---|---|
| Nitrocellulose | 1.5 g |
| Silica particles of average particle size 2 μm | 0.04 g |
| Methanol | 95 ml |
| Methyl Cellosolve | 5 ml |

and applied over the recording layer. The coating was dried at 120° C. for 90 seconds to a dry coat thickness of approximately 0.2 μm.

Distilled water at a temperature of 20° C. was sprayed onto the anti-water marking composition and spread by means of a roller into a continuous film of approximate coat weight 150 $\mu g/cm^2$ immediately before reeling the wet film under tension into a master roll. After storing the master roll at ambient temperature (18° C.) for 2 weeks it was slit into 105 mm wide rolls.

Upon unwinding the slit rolls, it was found that the applied water had been absorbed into the surface coatings and that the surface of the anti-water making layer was dry and free from water marking.

The maximum projection density ($D_{max}$), comparative speed rating and gamma were determined by the tests described in the above definition of terms with the results shown in Table 1. By way of comparison, the same properties were determined for a film (as Control 1) made as above but replacing the cold water treatment with a conventional hot water treatment by immersion in a hot water bath at 80° C. for 10 seconds followed by drying at 20° C. for 60 seconds.

TABLE 1

| | $D^{max}$ | Comparative speed rating | Bar-Gamma |
|---|---|---|---|
| Example 1 | 2.67 | 134 | 3.0 |
| Control 1 | 2.63 | 100 | 2.3 |

The film prepared in accordance with the invention (Example 1) exhibited significant improvements in speed and gamma in comparison with the film of Control 1 which had been subjected to a conventional hot water treatment. The film of Example 1 was especially suitable for the copying of masters produced from conventional silver halide photographic films.

EXAMPLE 2

Example 1 was repeated using a vinylidene chloride/acrylonitrile/methyl methacrylate terpolymer (42.5/42.5/15 mole % respectively) coating formulation for the recording layer, as specified below, in place of that described in Example 1:

| | |
|---|---|
| Vinylidene chloride/acrylonitrile/ methyl methacrylate terpolymer (42.5/42.5/15 mole %) | 23.25 kg |
| Maleic acid | 0.23 kg |
| 'Manoxol' OT (a commercially available surfactant - sodium dioctyl sulphosuccinate) | 0.465 kg |
| 2,5-diethoxy-4-N-morpholino-benzene diazonium fluoroborate | 1.86 kg |
| Bis-(4-hydroxyphenyl) sulphone | 1.16 kg |
| Blue dyestuff (commercially available as 'Orasol' Blue BLN) | 0.14 kg |
| Methyl ethyl ketone | 138 liters |
| Methyl Cellosolve | 17 liters |

The photographic characteristics of the resulting recording material are shown in Table 2 together with those of a similar film (Control 2) which had been subjected to a conventional hot water treatment by immersion in a hot water bath at 80° C. for 10 seconds followed by drying at 20° C. for 60 seconds. The surface of the recording layer of Example 2 was dry and free from water marking.

TABLE 2

| | $D_{max}$ | Comparative speed rating | Bar-Gamma |
|---|---|---|---|
| Example 2 | 2.66 | 95 | 3.3 |
| Control 2 | 2.62 | 87 | 3.0 |

EXAMPLE 3

The sensitised vinylidene chloride terpolymer layers of samples of the vesicular recording material described in Example 2 were coated with a continuous layer of distilled water of approximate coat weight 150 $\mu g/cm^2$. The samples were then maintained at 20° C. for the treatment times mentioned in Table 3.

At the end of the treatment time each sample was shaken to remove surplus water and blotted dry. The sample was allowed to stand for 30 minutes to permit the release of absorbed water from the sensitised layer prior to imagewise exposure for the determination of maximum projection density, comparative speed rating and bar-gamma, the values being shown in Table 3.

TABLE 3

| Aqueous treatment times in minutes | $D_{max}$ | Comparative speed rating | Bar-gamma |
|---|---|---|---|
| 20 | 0.88 | — | 2.2 |
| 40 | 2.11 | 57 | 3.2 |
| 50 | 2.4 | 95 | 3.26 |
| 60 | 2.5 | 129 | 3.3 |
| 75 | — | 133 | 3.38 |
| 90 | 2.6 | 130 | 3.35 |
| 110 | — | 134 | 3.42 |
| 180 | 2.6 | — | 3.5 |

We claim:

1. A process for the production of a vesicular recording material, which comprises producing a plastics vehicle comprising a thermoplastics component having dispersed uniformly therein a sensitising agent which releases a vesicle-forming gas upon exposure to light, said thermoplastics components being water-insoluble and softenable upon heating to permit the gas released insoluble and softenable upon heating to permit the gas released by the sensitising agent in the light-struck areas to form light-scattering or reflecting vesicles therein, wherein a layer of an aqueous medium is applied to the surface of the plastics vehicle, and the wet recording material is wound into a roll, the wound wet recording material then being maintained at a temperature in the range 5° to 30° C. for at least 45 minutes.

2. A process according to claim 1, in which the aqueous treatment is effected for at least 60 minutes.

3. A process according to claim 1, in which the aqueous treatment is effected for at least 70 minutes.

4. A process according to claim 1, in which the aqueous medium is applied to the plastics vehicle at a surface concentration in the range of 50 to 300 $\mu g/cm^2$.

5. A process according to claim 1, in which the plastics vehicle is coated prior to treatment with the aqueous medium with a layer of a material which suppresses water-marking, a layer of the aqueous medium is applied to the plastics vehicle of the recording material and the wet recording material is wound into a roll, the wound wet recording material then being maintained at a temperature in the range 5° to 30° C. for at least 45 minutes.

6. A process according to claim 6, in which the material which suppresses water-marking is nitrocellulose.

7. A process according to claim 1, in which the aqueous medium includes an alkanol which is effective in the suppression of water-marking.

8. A process for the production of a vesicular recording material, which comprises producing a plastics vehicle comprising a thermoplastic terpolymer of vinylidene chloride/acrylonitrile or a derivative thereof/-methyl methacrylate having dispersed uniformly therein a sensitising agent which is capable of releasing a vesicle-forming gas upon exposure to light, said terpolymer being water-insoluble and softenable upon heating to permit the gas released by the sensitising agent in the light-struck areas to form light-scattering or reflecting vesicles therein, wherein a layer of an aqueous medium is applied to the surface of the plastics vehicle, and the wet recording material is wound into a roll, the wound wet recording material then being maintained at a temperature in the range 5° to 30° C. for at least 45 minutes.

* * * * *